US008727118B1

(12) United States Patent
Chen

(10) Patent No.: US 8,727,118 B1
(45) Date of Patent: May 20, 2014

(54) ROTARY TOOL BOX

(71) Applicant: Chao-Ming Chen, Taichung (TW)

(72) Inventor: Chao-Ming Chen, Taichung (TW)

( * ) Notice: Subject to any disclaimer, the term of this patent is extended or adjusted under 35 U.S.C. 154(b) by 0 days.

(21) Appl. No.: 13/719,056

(22) Filed: Dec. 18, 2012

(51) Int. Cl.

| | |
|---|---|
| ***B65D 83/00*** | (2006.01) |
| ***B25H 3/00*** | (2006.01) |
| ***B65D 85/28*** | (2006.01) |
| *B25H 3/02* | (2006.01) |
| *B65D 73/00* | (2006.01) |
| *A45C 11/26* | (2006.01) |

(52) U.S. Cl.
CPC . *B65D 85/28* (2013.01); *B25H 3/00* (2013.01); *B25H 3/025* (2013.01); *B65D 73/00* (2013.01); *A45C 11/26* (2013.01)
USPC ..... 206/372; 206/378; 206/373; 206/374; 206/376; 206/377; 211/70.6; 211/69; 211/131.2

(58) Field of Classification Search
CPC ..... B25H 3/00; B25H 3/025; B65D 2211/00; B65D 85/28; B65D 73/00; B65D 85/20; A45C 11/26
USPC ..... 206/378, 372–374, 376, 377, 379; 211/70.6, 69, 131.2; 81/490, 177.4; 422/300; D9/415, 418, 428, 429, 718
See application file for complete search history.

(56) References Cited

U.S. PATENT DOCUMENTS

| | | | | | |
|---|---|---|---|---|---|
| 2,978,285 | A | * | 4/1961 | Jester | 312/284 |
| 4,627,315 | A | * | 12/1986 | Lin | 81/177.4 |
| 4,930,953 | A | * | 6/1990 | Fischer | 409/134 |
| 5,029,706 | A | * | 7/1991 | McCracken | 206/349 |
| 5,150,788 | A | * | 9/1992 | Weissman | 206/369 |
| D341,777 | S | * | 11/1993 | Sheu | D9/415 |
| D352,219 | S | * | 11/1994 | Chow | D8/71 |
| 5,441,163 | A | * | 8/1995 | Carrasco | 220/23.86 |
| 5,465,556 | A | * | 11/1995 | Wooldridge et al. | 53/468 |
| D370,626 | S | * | 6/1996 | Pass et al. | D9/415 |
| 5,535,882 | A | * | 7/1996 | Liu | 206/377 |
| 5,595,296 | A | * | 1/1997 | Wood | 206/363 |
| 5,799,789 | A | * | 9/1998 | Ritchie et al. | 206/378 |
| 5,848,694 | A | * | 12/1998 | Newton | 206/373 |
| D410,145 | S | * | 5/1999 | Chen | D3/273 |
| 5,941,430 | A | * | 8/1999 | Kuwabara | 223/109 R |
| 6,237,451 | B1 | * | 5/2001 | Wei | 81/490 |
| 6,431,034 | B1 | * | 8/2002 | Chen | 81/177.4 |
| D466,382 | S | * | 12/2002 | Sorensen et al. | D8/29 |
| 6,840,377 | B2 | * | 1/2005 | Yu | 206/377 |
| 7,441,654 | B2 | * | 10/2008 | Liu | 206/349 |
| D590,152 | S | * | 4/2009 | Reines | D3/273 |
| D645,733 | S | * | 9/2011 | Holtan | D9/415 |
| 8,157,092 | B2 | * | 4/2012 | Christopher | 206/374 |
| D665,639 | S | * | 8/2012 | Albertson | D8/25 |
| D678,675 | S | * | 3/2013 | Lin | D3/273 |
| D684,462 | S | * | 6/2013 | Hite | D9/429 |

(Continued)

*Primary Examiner* — Mickey Yu
*Assistant Examiner* — Gideon Weinerth

(57) ABSTRACT

A rotary tool box contains a base including a plurality of receiving portions for receiving plural tools and at least one accommodation room for holding at least one driving tool, at least one end of which extends out of the at least one accommodation room; a covering member covered on the base and including at least one orifice defined on a top surface thereof so as to take or place the at least one driving tool, the covering member also including at least one slot formed on an outer surface thereof so that the at least one end of the at least one driving tool extends out of the accommodation room and is engaged.

9 Claims, 16 Drawing Sheets

(56) References Cited

U.S. PATENT DOCUMENTS

| | | | | |
|---|---|---|---|---|
| 8,468,915 | B2 * | 6/2013 | Hu | 81/63.1 |
| 8,517,173 | B2 * | 8/2013 | Gui et al. | 206/349 |
| 2002/0027092 | A1 * | 3/2002 | Hu | 206/378 |
| 2004/0016667 | A1 * | 1/2004 | Chen | 206/373 |
| 2004/0089620 | A1 * | 5/2004 | Chen | 211/70.6 |
| 2004/0094444 | A1 * | 5/2004 | Chen | 206/376 |
| 2004/0099553 | A1 * | 5/2004 | Chen | 206/349 |
| 2004/0251153 | A1 * | 12/2004 | Chen | 206/375 |
| 2005/0087465 | A1 * | 4/2005 | Chang | 206/373 |
| 2005/0161356 | A1 * | 7/2005 | Chen | 206/373 |
| 2005/0189250 | A1 * | 9/2005 | Hsu | 206/373 |
| 2005/0247587 | A1 * | 11/2005 | Holland-Letz | 206/373 |
| 2006/0070902 | A1 * | 4/2006 | Tuan-Mu et al. | 206/378 |
| 2006/0260964 | A1 * | 11/2006 | Feldmann et al. | 206/373 |
| 2006/0283739 | A1 * | 12/2006 | Wang | 206/379 |
| 2007/0023307 | A1 * | 2/2007 | Liu | 206/373 |
| 2007/0095691 | A1 * | 5/2007 | Lin | 206/378 |
| 2008/0083304 | A1 * | 4/2008 | Finn | 81/177.4 |
| 2008/0296187 | A1 * | 12/2008 | Butzen et al. | 206/379 |
| 2011/0226648 | A1 * | 9/2011 | Zhang | 206/374 |
| 2012/0000805 | A1 * | 1/2012 | Liu | 206/372 |
| 2012/0043239 | A1 * | 2/2012 | Kriz et al. | 206/375 |

* cited by examiner

ROTARY TOOL BOX

FIELD OF THE INVENTION

The present invention relates to a rotary tool box which has a theft proof and display function.

BACKGROUND OF THE INVENTION

FIG. 1 shows a conventional tool holder for holding sleeves. The tool holder 10 includes a base 11 and a plurality of holding mounts 12. The base 11 is elongated and has two sliding rails 111 fixed on two sides thereof. Each holding mount 12 has two recesses 121 defined on two sides of a bottom end thereof so as to correspond to the two sliding rails 111, such that the each holding mount 12 is slidably mounted on the base 11. Also, the each holding mount 12 has a quadrilateral retaining portion 122 disposed on a top end thereof so as to insert a fitting segment 21 of a socket 20, wherein the fitting segment 21 is a quadrilateral hole, such that a plurality of sleeves 20 with different sizes are placed on the tool holder 10. Unfortunately, the tool holder 10 cannot provide a theft-proof function, so the plurality of sleeves 20 are stolen easily when the tool holder 10 is displayed in a store for sales.

An improved tool holder 30 with a heft-proof function is disclosed in TW Pat. No. M414306 contains a holding seat 31 and a cover 32. The holding seat 31 includes a socket wrench 41 disposed thereon and a plurality of mounts 311 fixed on one side thereof, each mount 311 has a retainer 312 fixed therein so as to hold a sleeve 42, and two hook posts 313 are disposed on a connection of two adjacent mounts 311, and two locking blocks 314 are mounted on a uppermost mount 311 and a lowest mount 311. The cover 32 includes plural recesses 321 corresponding to the plurality of mounts 311, two locking orifices 322 corresponding to the two hook posts 313, and two notches 323 corresponding to the two locking blocks 314, such that a plurality of sleeves 42 are inserted into the plurality of mounts 311, and then the cover 32 is covered on the plurality of mounts 311. Thereby, the two notches 323 retain with the two locking blocks 314, and the two hook posts 313 extend out of the two locking orifices 322 and are locked, hence the cover 32 will not removed from the holding seat 31 as to obtain a theft-proof function. Nevertheless, as the user intends to remove a desired sleeve 42 from a mount 311, he/she has to disengage the two notches 323 from the two locking blocks 314 so as to further remove the cover 32 from the holding seat 31. As putting the sleeve 42 back to the holding seat 31, the user has to retain the two notches 323 with the two locking blocks 314, thus having a complicated operation.

The present invention has arisen to mitigate and/or obviate the afore-described disadvantages.

SUMMARY OF THE INVENTION

The primary object of the present invention is to provide a rotary tool box which has a theft-proof and display function.

Secondary object of the present invention is to provide a rotary tool box which is capable of removing a tool from the rotary tool box and placing the tool into the rotary tool box easily.

Further object of the present invention is to provide a rotary tool box in which the connecting structure is defined so as to prevent the covering member from disengagement from the base.

Another object of the present invention is to provide a rotary tool box in which the covering member is transparent so that consumers select a tool with a desired size.

To obtain the above objective, a rotary tool box provided by the present invention contains:

a base including a plurality of receiving portions for receiving plural tools and at least one accommodation room for holding at least one driving tool, at least one end of which extends out of the at least one accommodation room;

a covering member covered on the base and including at least one orifice defined on a top surface thereof so as to remove or place the at least one driving tool, the covering member also including at least one slot formed on an outer surface thereof so that the at least one end of the at least one driving tool extends out of the accommodation room and is engaged.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
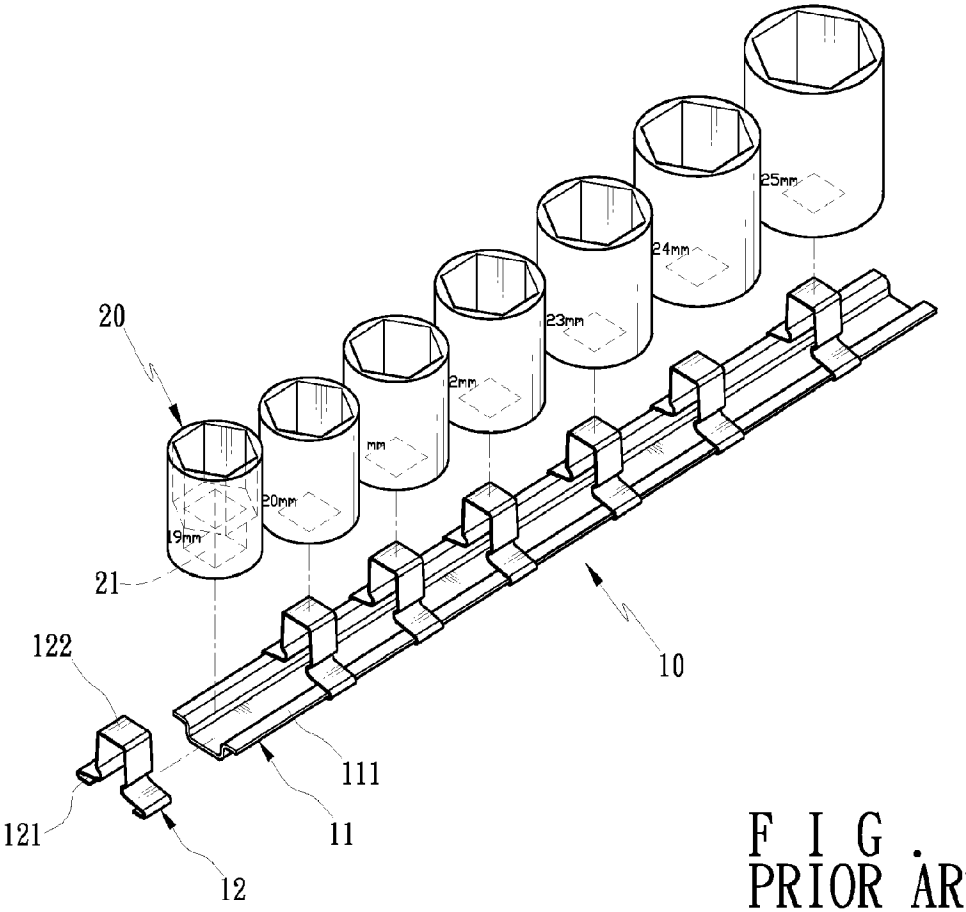
FIG. 1 PRIOR ART
FIG. 1 shows a conventional tool holder for holding sleeves.
Figure 2:
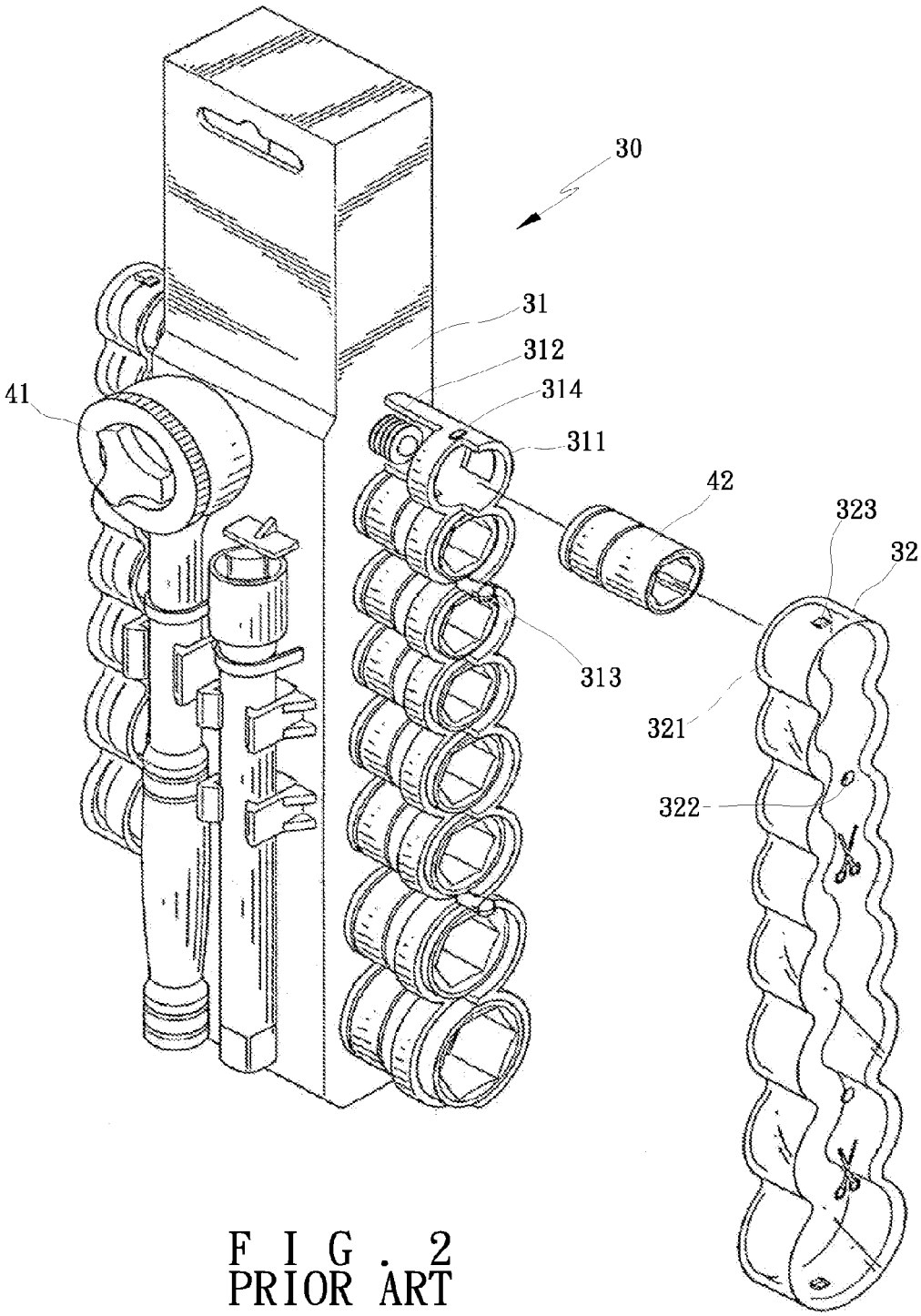
FIG. 2 PRIOR ART
FIG. 2 shows another conventional tool holder for holding sleeves.
Figure 3:
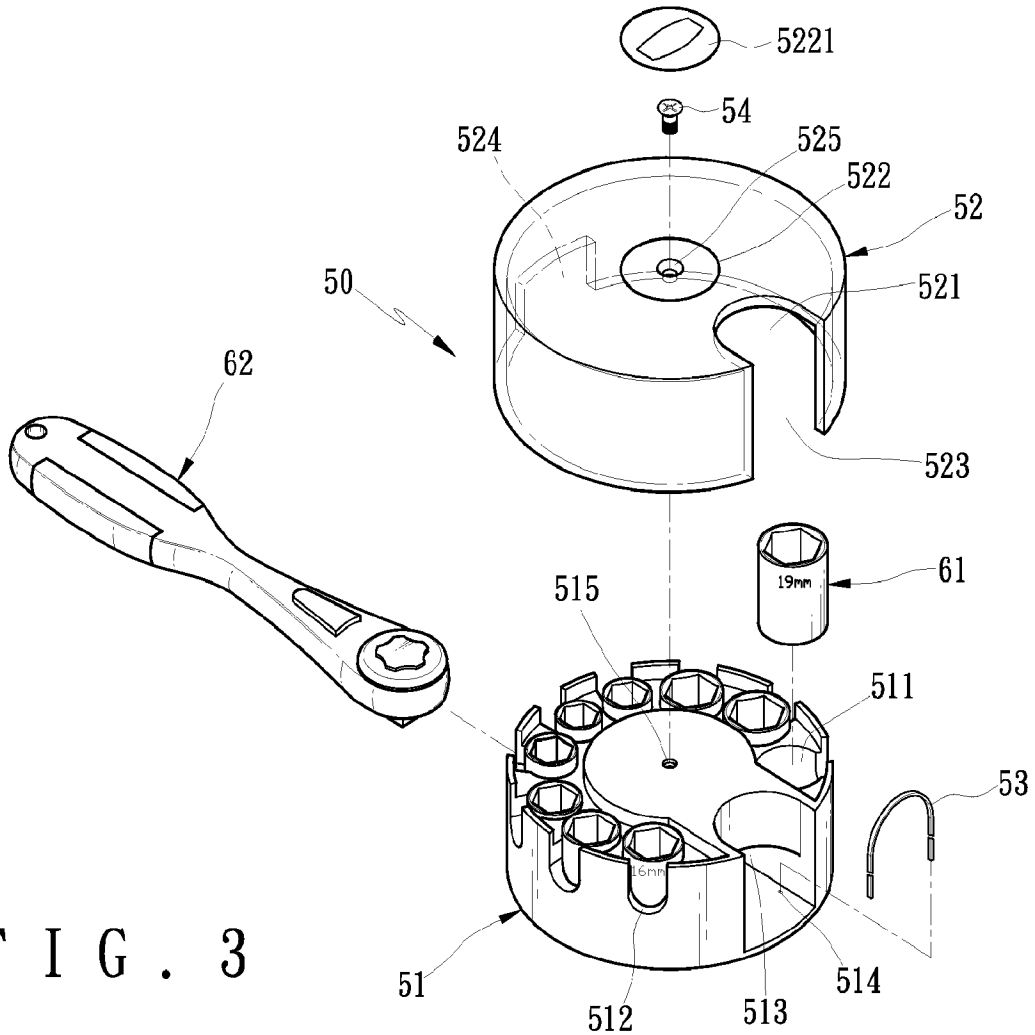
FIG. 3 is a perspective view showing the exploded components of a rotary tool box according to a first embodiment of the present invention.
Figure 4:
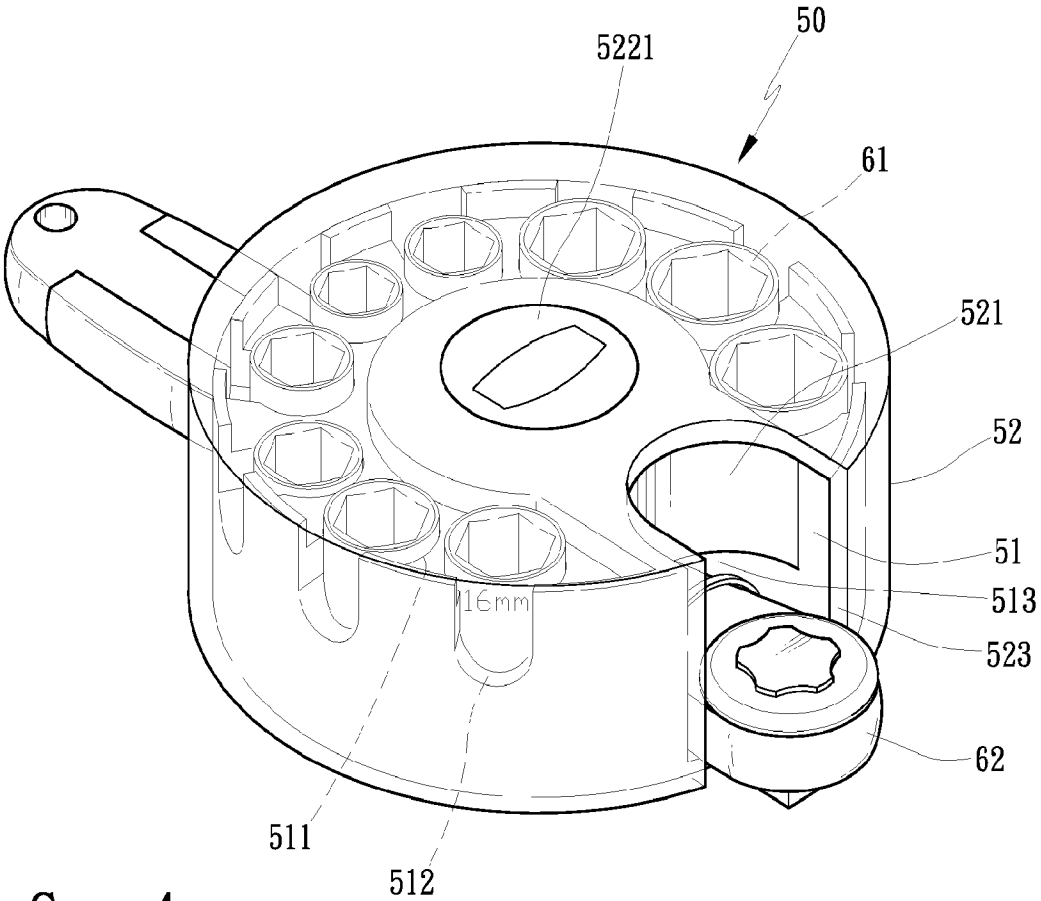
FIG. 4 is a perspective view showing the assembly of the rotary tool box according to the first embodiment of the present invention.

FIG. 3 is a perspective view showing the exploded components of a rotary tool box according to a first embodiment of the present invention. FIG. 4 is a perspective view showing the assembly of the rotary tool box according to the first embodiment of the present invention. The rotary tool box 50 comprises a base 51 and a covering member 52. The base 51 includes a plurality of receiving portions for receiving plural tools (such as sleeves, bits, and the like). In this embodiment, the base 51 is circular and each receiving portion is a groove 511 defined on a top surface thereof, such that a plurality of grooves 511 of the base 51 receive plural sleeves 61 with different sizes. Also, the base 51 includes a plurality of recesses 512 formed around an outer surface thereof and communicating with the plurality of grooves 511. In this embodiment, the plurality of recesses 512 pass through the outer surface of the base 51 and the plurality of grooves 511 so that the plural sleeves 61 in the plurality of grooves 511 are removed by a user. In addition, the base 51 includes at least one driving tool (such as a socket wrench or a connecting rod) fitted thereon. In addition, the base 51 includes at least one accommodation room for holding the at least one driving tool. In this embodiment, the base 51 includes an accommodation room 513, two ends of which pass through the outer surface of the base 51, such that a socket wrench 62 is fitted to the base 51 and its two ends extend out of the accommodation room 513. The tool box 50 includes a fixing structure with at least one positioning member by which the at least one driving tool is fixed on the base 51, and the at least one positioning member is a fastening element or a locking block. In this embodiment, the fixing structure includes a plurality of through holes 514 defined at plural predetermined positions of a bottom surface of the accommodation room 513 so as to insert a fastening element 53 by which the socket wrench 62 is fixed on the base 51. The covering member 52 is circular and transparent and includes at least one orifice 521 defined on a top surface thereof so as to take or place the at least one driving tool. The covering member 52 also includes at least one marking area 522 for marking a trademark and/or a model. In this embodiment, the at least one marking area 522 is used to attach a label 5221 with the trademark and the model. The covering member 52 also includes at least one slot formed on an outer surface thereof so that at least one end of the at least one driving tool extends out of the accommodation room 513 of the base 51 and is engaged. In this embodiment, the covering member 52 includes two opposite slots 523, 524 formed on the outer surface thereof, and a slot 523 communicates with the at least one orifice 521, such that the covering member 52 is covered on the base 51, and the two opposite slots 523, 524 correspond to the two ends of the accommodation room 513 of the base 51 so that two ends of the socket wrench 62 extend out of the accommodation room 513 and are engaged, thus limiting a rotation of the covering member 52. Furthermore, between the covering member 52 and the base 51 is defined a connecting structure for preventing the covering member 52 from disengagement from the base 51. The connecting structure includes a raised ring and a trench for mating with the raised ring or a bolt element for locking the covering member 52 and the base 51. In this embodiment, the connecting structure includes a threaded aperture 515 defined on a central position of the top surface of the base 51 and an opening 525 formed on the top surface of the covering member 52 so as to correspond to the threaded aperture 515 of the base 51, and the bolt element 54 screws with the threaded aperture 515 of the base 51 via the opening 525 of the covering member 52, such that the covering member 52 connects with the base 51, thus assembling the tool box 50.

Figure 5:
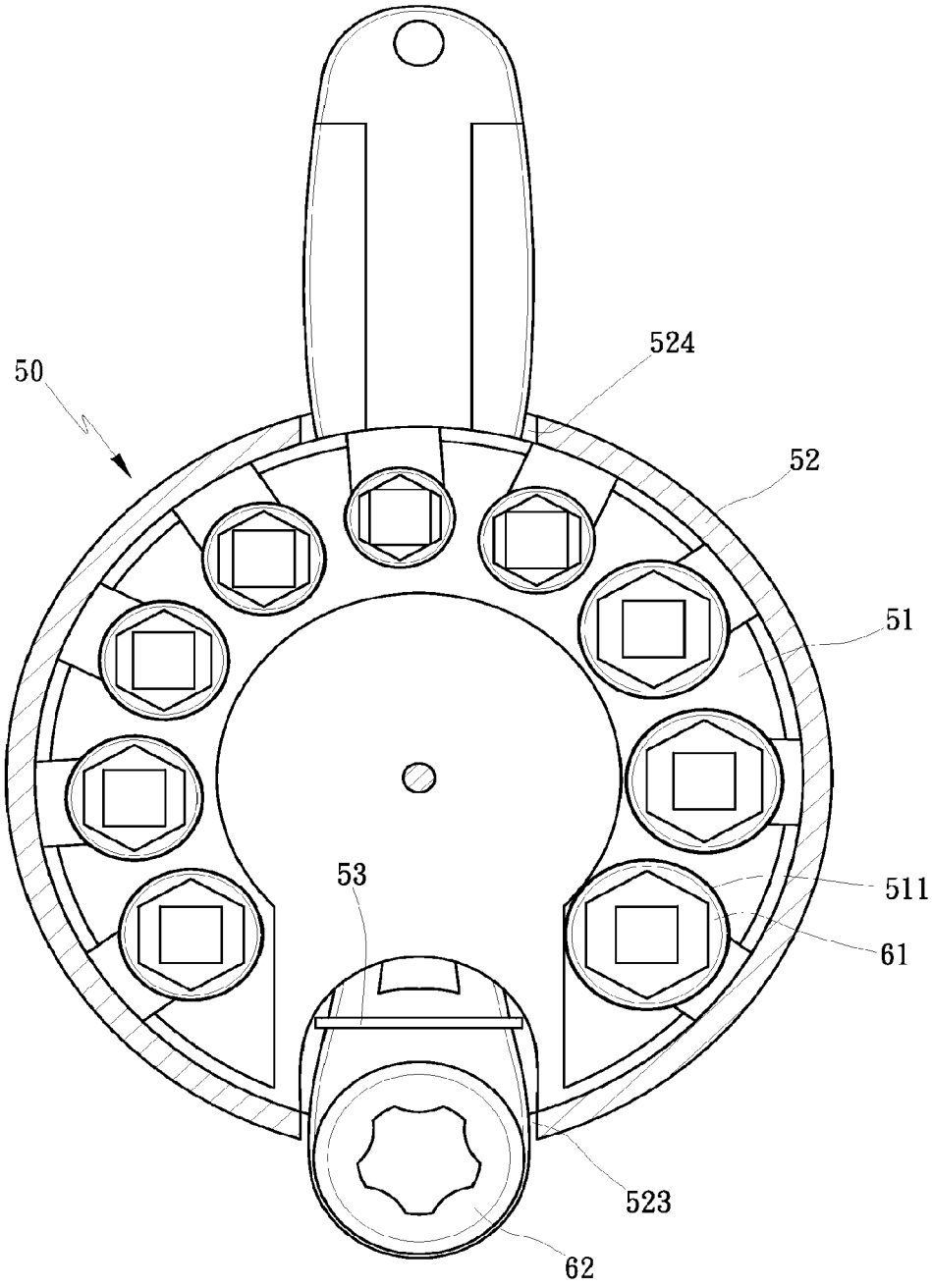
FIG. 5 is a cross sectional view showing the assembly of a part of the rotary tool box according to the first embodiment of the present invention.
Figure 6:
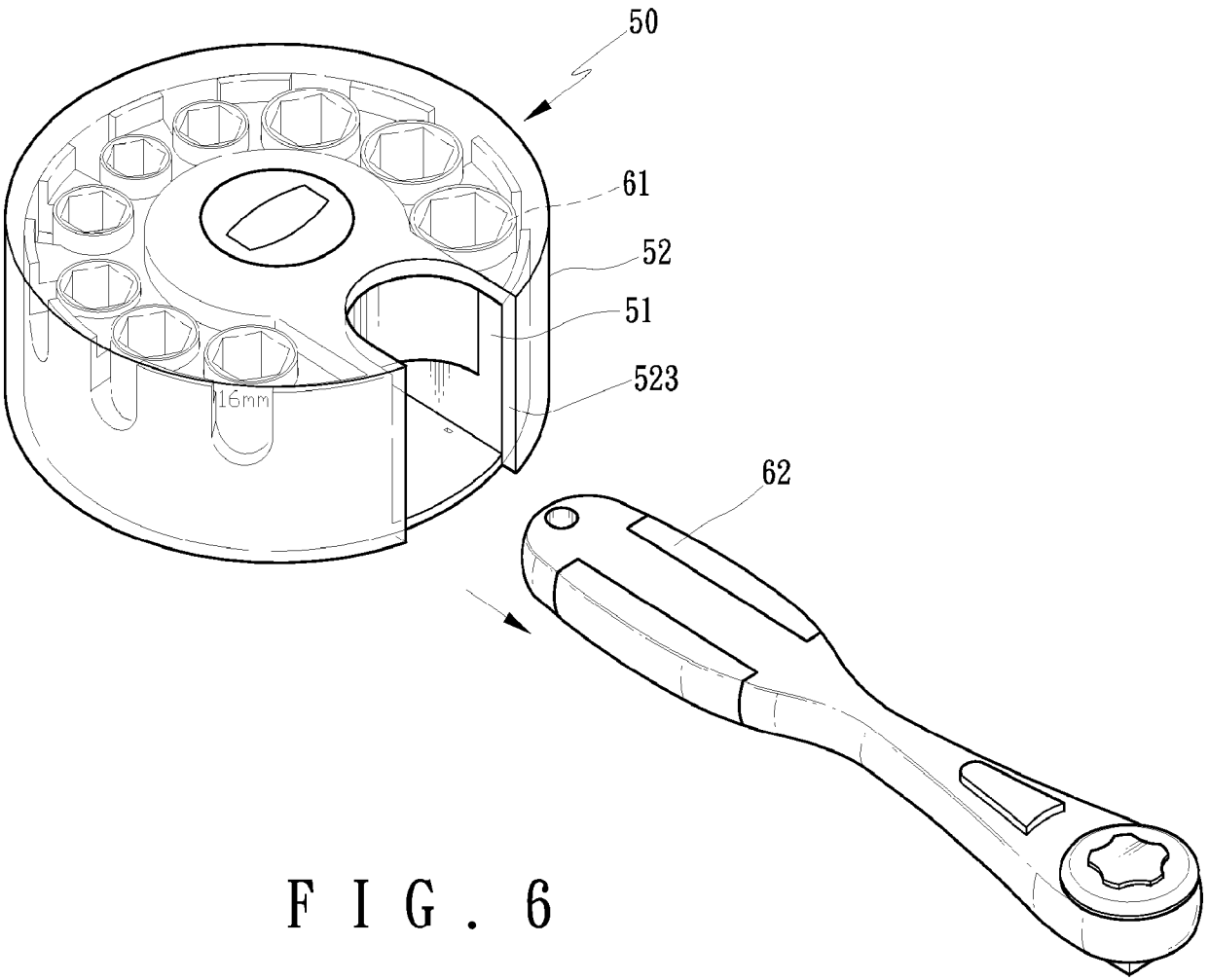
FIG. 6 is a perspective view showing the operation of the rotary tool box according to the first embodiment of the present invention.
Figure 7:
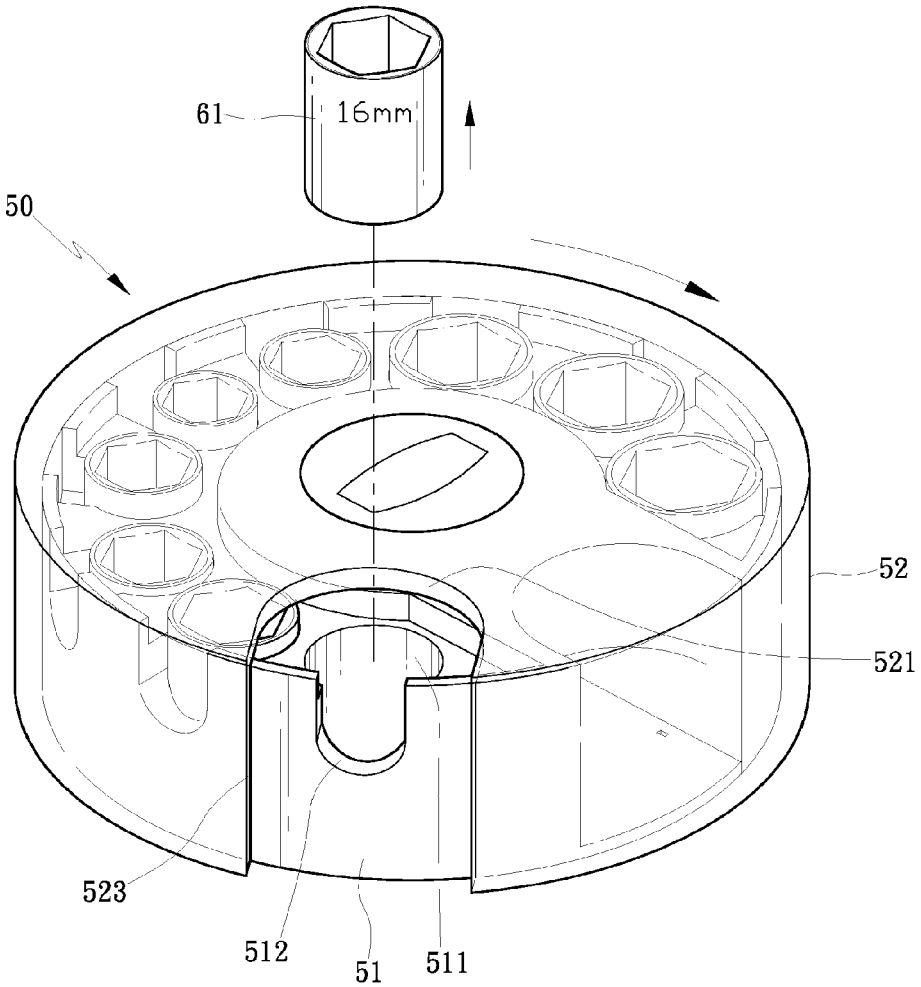
FIG. 7 is another perspective view showing the operation of the rotary tool box according to the first embodiment of the present invention.
Figure 8:
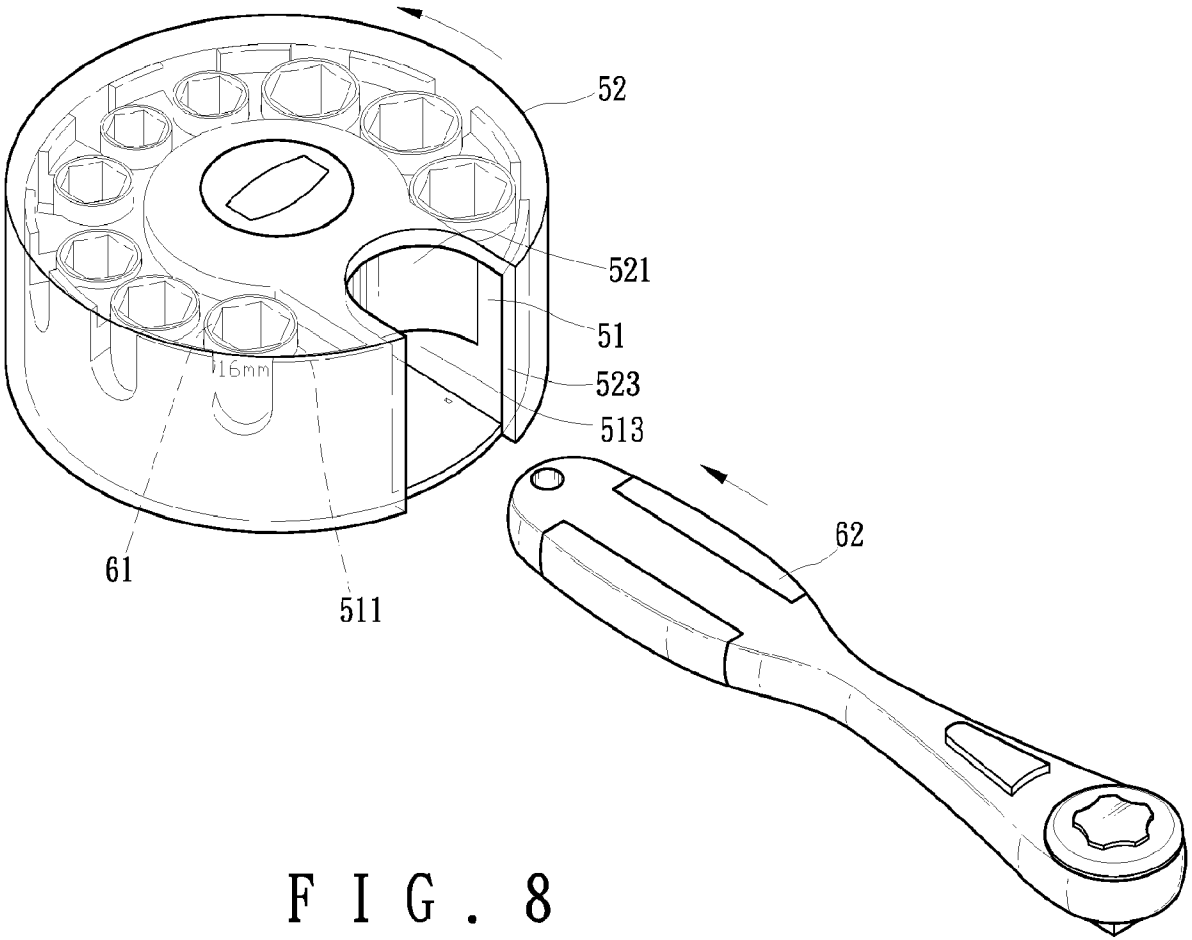
FIG. 8 is also another perspective view showing the operation of the rotary tool box according to the first embodiment of the present invention.

Referring further to FIGS. 4 and 5, when the tool box 50 is placed in the store for sales, because the covering member 52 is transparent, the plural sleeves 61 are received in the base 51 for display to consumers. Thereby, the consumer allows selecting one of the plural sleeves 61 with a desired size. Moreover, the tool box 50 is provided to store the socket wrench 62 for driving the plural sleeves 61, and the two ends of the socket wrench 62 extend out of the accommodation room 513 so as to be used as two stopping shoulders, hence the two opposite slots 523, 524 of the covering member 52 engage with the two ends of the socket wrench 62, thus limiting the rotation of the covering member 52. Since the at least one orifice 521 of the covering member 52 does not correspond to the plurality of grooves 511 of the base 51 so that the covering member 52 limits the plural sleeves 61 in the base 51, thus preventing the plural sleeves 61 from being stolen. As shown in FIGS. 5 and 6, after the consumer purchases the plural sleeves 61 and the tool box 50 of the socket wrench 62, the fastening element 53 is removed from the base 51 so as to release a positioning of the socket wrench 62, hence the socket wrench 62 is pulled out of the slot 523 of the covering member 52. With reference to FIGS. 5 and 7, because the socket wrench 62 is pulled out of the two opposite slots 523, 524 of the covering member 52, when the consumer is desired to remove the plural sleeves 61 from the tool box 50, the covering member 52 is rotated along the outer surface of the base 51 so that the at least one orifice 521 of the covering member 52 corresponds to a desired sleeve 61 in the base 51. Since the plurality of recesses 512 pass through the outer surface of the base 51 and the plurality of grooves 511, the consumer manually removes the desired sleeve 61 from the at least one orifice 521 of the covering member 52, and the other sleeves 61 are limited in the base 51. As illustrated in FIGS. 4 and 8, when storing the plural sleeves 61 and the socket wrench 62 in the tool box 50, the plural sleeves 61 are inserted into the plurality of grooves 511 of the base 51 via the at least one orifice 521, and the covering member 52 is rotated so that the two opposite slots 523, 524 of the covering member 52 correspond to the accommodation room 513 of the base 51, thereafter the socket wrench 62 is inserted into the accommodation room 513 of the base 51 through the two opposite slots 523, 524 of the covering member 52, and the two opposite slots 523, 524 of the covering member 52 retain with the two ends of the socket wrench 61 so as to prevent the covering member 52 from rotation, thus storing the plural sleeves 61 in base 51 of the tool base 50.

Figure 9:
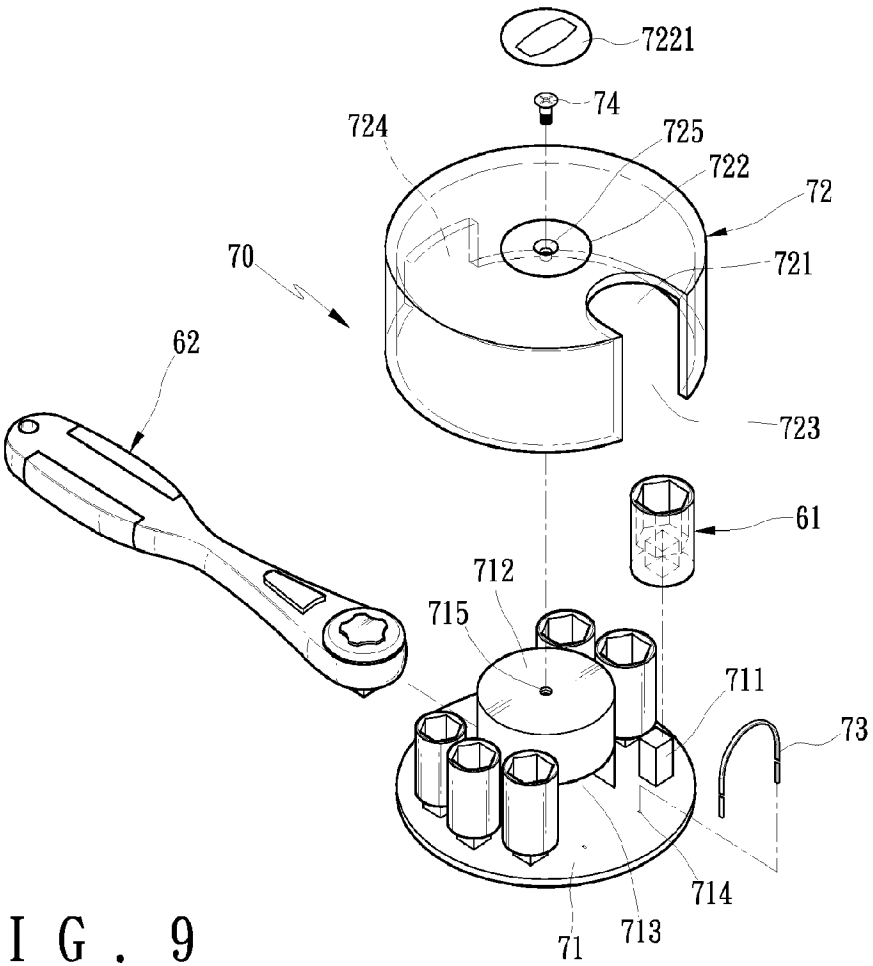
FIG. 9 is a perspective view showing the exploded components of a rotary tool box according to a second embodiment of the present invention.
Figure 10:
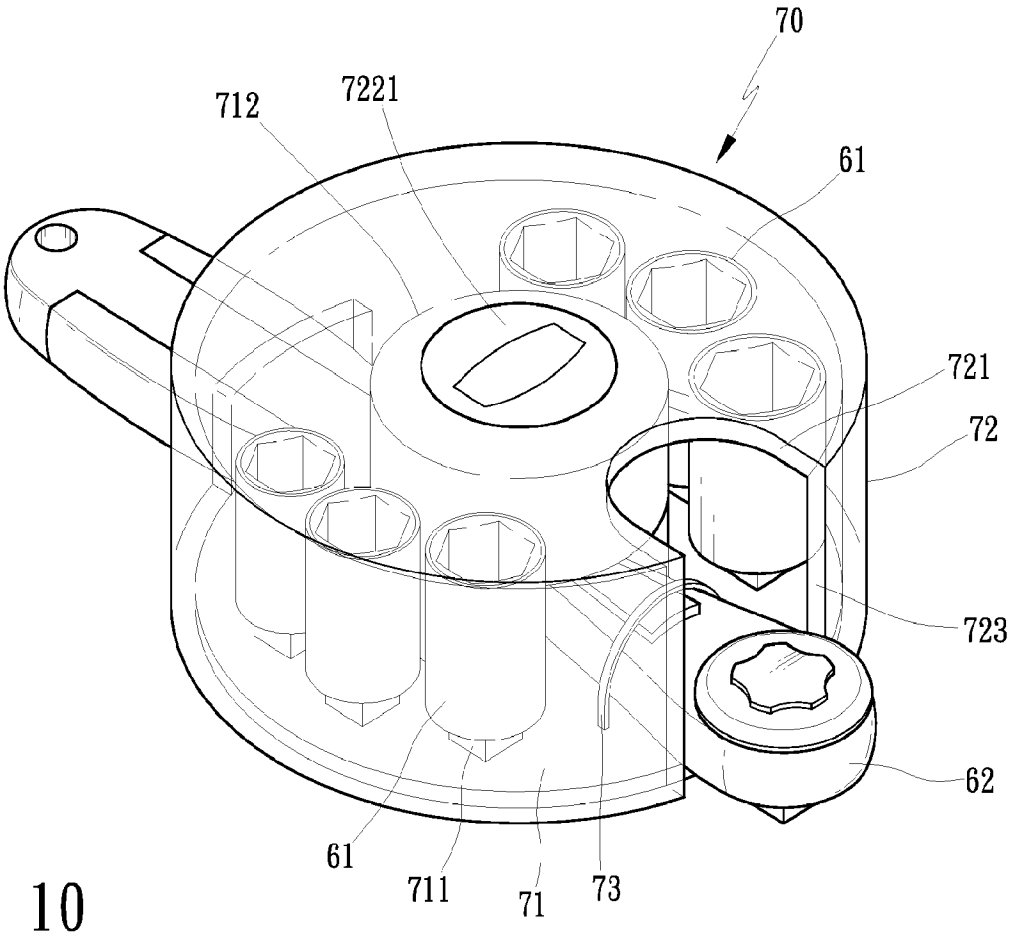
FIG. 10 is a perspective view showing the assembly of the rotary tool box according to the second embodiment of the present invention.
Figure 11:
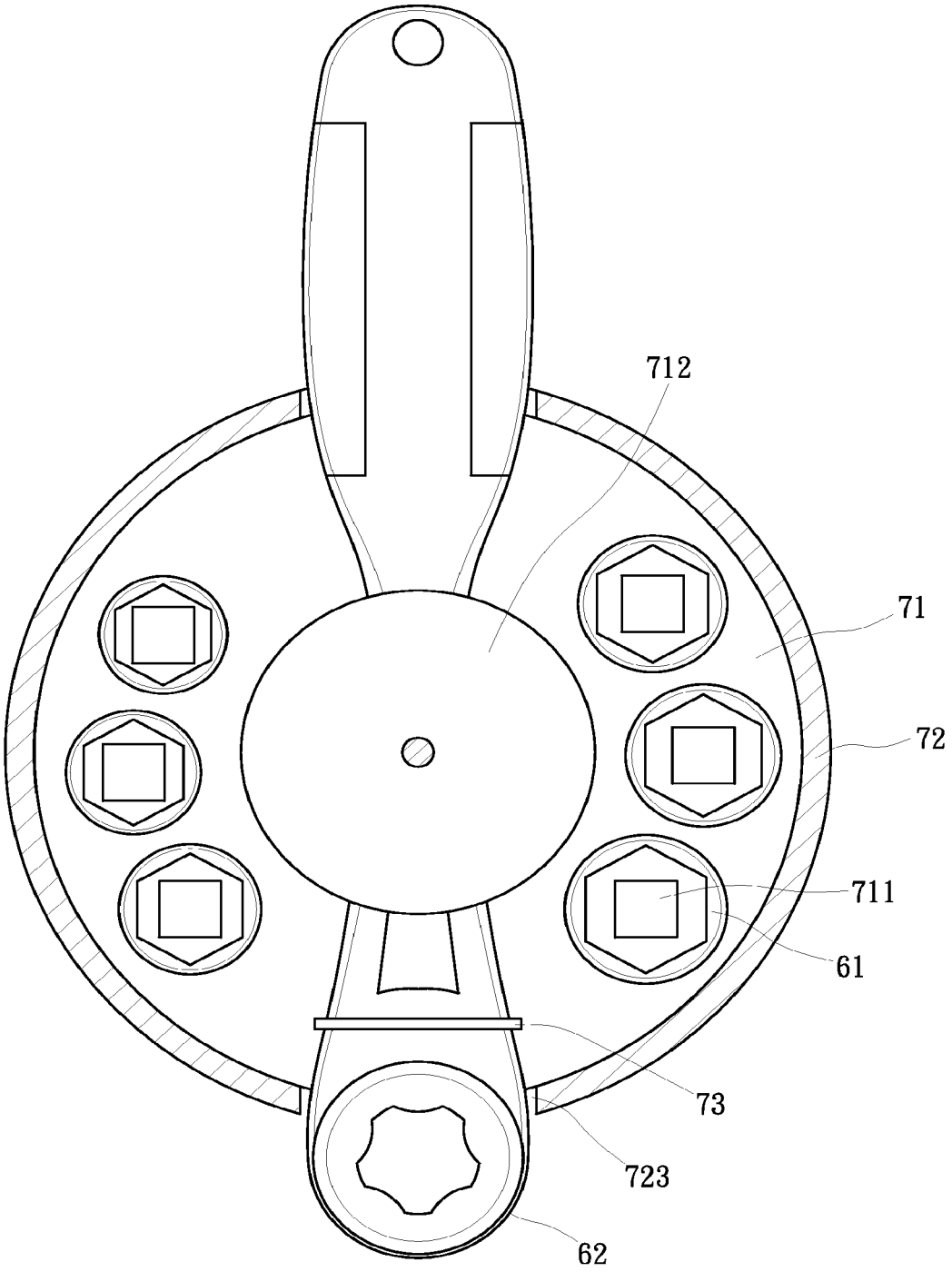
FIG. 11 is a cross sectional view showing the assembly of the rotary tool box according to the second embodiment of the present invention.

FIG. 9 is a perspective view showing the exploded components of a rotary tool box according to a second embodiment of the present invention. FIG. 10 is a perspective view showing the assembly of the rotary tool box according to the second embodiment of the present invention. FIG. 11 is a cross sectional view showing the assembly of the rotary tool box according to the second embodiment of the present invention. A rotary tool box 70 of this embodiment comprises a base 71 and a covering member 72. The base 71 is circular and includes a plurality of receiving portions (i.e., square receiving seats 711) for receiving plural sleeves 61 with different sizes, an upright column 712 extending upwardly from the base 71, an accommodation room 713 passing through the upright column 712 so that a socket wrench 62 is inserted into the accommodation room 713 and its two ends extend out of the accommodation room 713. A fixing structure of the tool box 70 includes a plurality of through holes 714 defined at plural predetermined positions of the base 71 so as to insert a fastening element 73 by which the socket wrench 62 is fixed on the base 71. The covering member 72 is circular and transparent and includes at least one orifice 721 defined on a top surface thereof so as to take or place the at least one tool. The covering member 52 also includes at least one marking area 722 for marking a trademark and/or a model. In this embodiment, the at least one marking area 722 is used to attach a label 7221 with the trademark and the model. In this embodiment, the covering member 72 includes two opposite slots 723, 724 formed on an outer surface thereof, and a slot 723 communicates with the at least one orifice 721, such that as the covering member 72 is covered on the base 71, two ends of the socket wrench 62 extend out of the accommodation room 713 and are engaged, thus limiting a rotation of the covering member 72. Furthermore, between the covering member 72 and the base 71 is defined a connecting structure. The connecting structure includes a threaded aperture 715 defined on a central position of the top surface of the base 71 and an opening 725 formed on the top surface of the covering member 72 so as to correspond to the threaded aperture 715 of the base 71, and a bolt element 74 screws with the threaded aperture 715 of the base 71 via the opening 725 of the covering member 72, such that the covering member 72 connects with the base 71, thus assembling the tool box 70.

Figure 12:
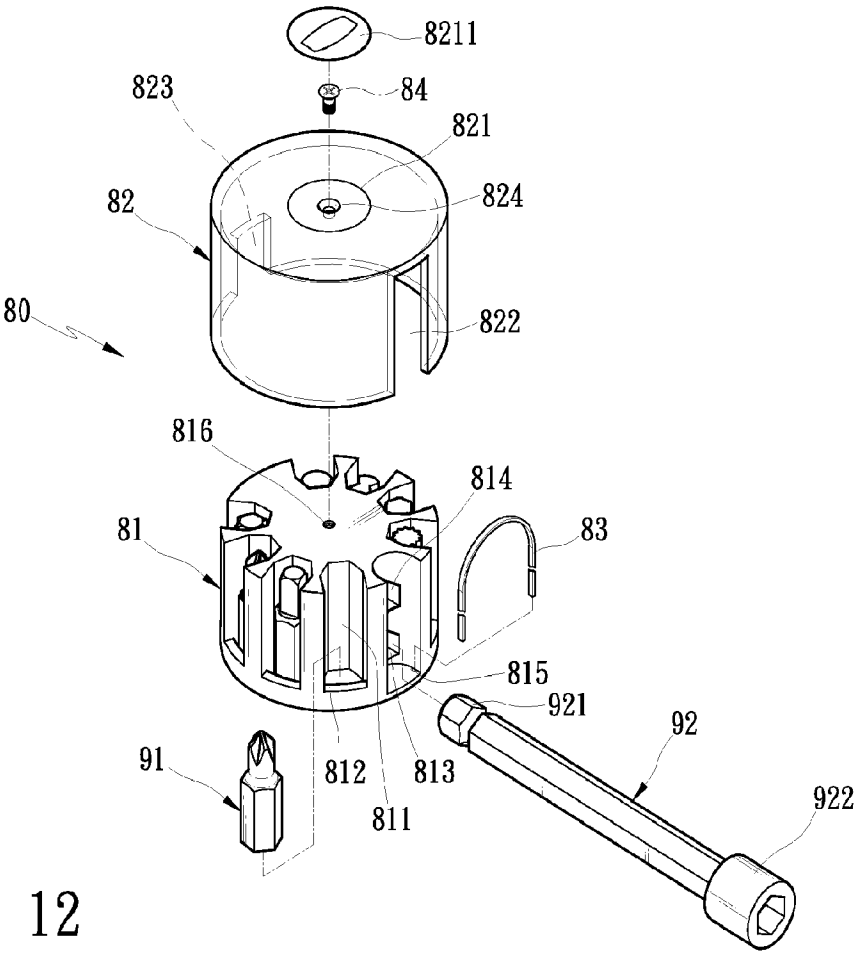
FIG. 12 is a perspective view showing the exploded components of a rotary tool box according to a third embodiment of the present invention.
Figure 13:
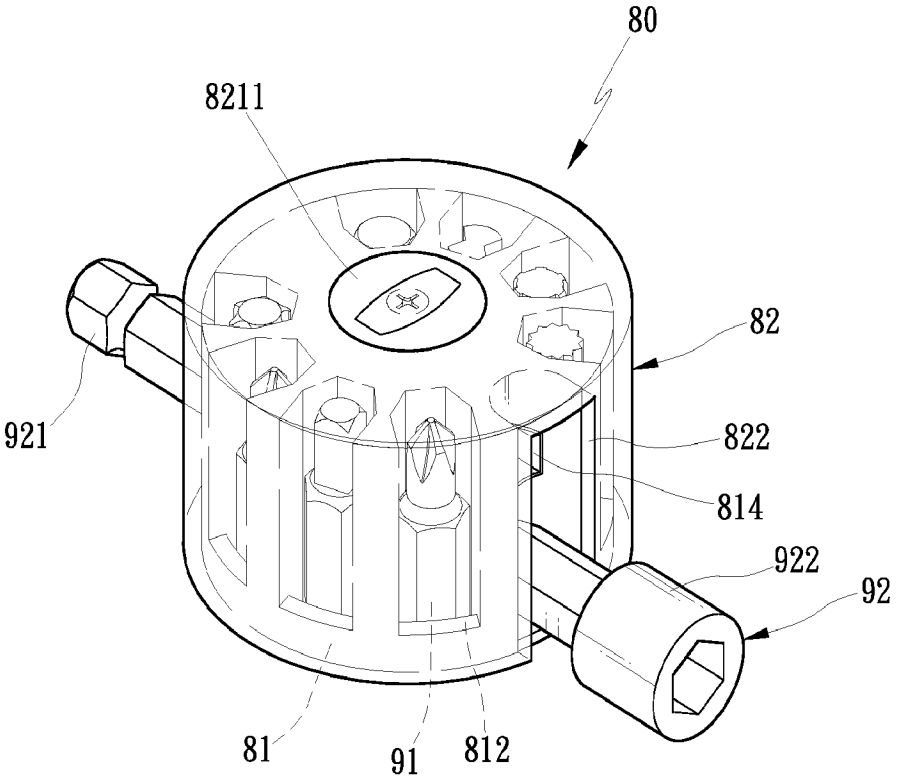
FIG. 13 is a perspective view showing the assembly of the rotary tool box according to the third embodiment of the present invention.

FIG. 12 is a perspective view showing the exploded components of a rotary tool box according to a third embodiment of the present invention. FIG. 13 is a perspective view showing the assembly of the rotary tool box according to the third embodiment of the present invention. A rotary tool box 80 of this embodiment comprises a base 81 and a covering member 82. The base 81 is circular and includes a plurality of receiving portions (i.e., a plurality of grooves 811) for receiving plural bits 91 with different sizes, a plurality of recesses 812 formed around an outer surface thereof and communicating with the plurality of grooves 811 so that the plural bits 91 are removed from the base 81. The base 51 also includes an accommodation room 813, two ends of which pass through the outer surface of the base 51, such that a driving tool (such as a connecting rod 92) is fitted to the base 81. The connecting rod 92 has an inserting segment 921 arranged on one end thereof and formed in a hexagonal column shape and has a fitting segment 922 arranged on another end of the connecting rod 92, wherein the fitting segment 922 has a hexagonal hole formed therein so as to insert a bit 91, the inserting segment 921 and the fitting segment 922 extend out of the accommodation room 813. The base 81 further includes a coupling portion 814 passing through the outer surface thereof, and the coupling portion 814 has a reinforcement element made of metal material. The tool box 80 includes a fixing structure with at least one positioning member by which the driving tool is fixed on the base 81. The fixing structure includes a plurality of through holes 815 defined at plural predetermined positions of a side of the accommodation room 813 so as to insert a fastening element 83 by which the connecting rod 92 is fixed on the base 81. The covering member 82 is circular and transparent and includes at least one marking area 821 for marking a trademark and/or a model. In this embodiment, the at least one marking area 821 is used to attach a label 8211 with the trademark and the model. The covering member 82 also includes at least one slot formed on an outer surface thereof so that at least one end of the driving tool extends out of the at least one slot and is engaged or disengaged. In this embodiment, the covering member 82 includes two opposite slots 822, 823 with different sizes formed on the outer surface thereof, and when the two opposite slots 822, 823 correspond to the two ends of the accommodation room 813 of the base 81, the covering member 82 is covered on the base 81, the fitting segment 922 and the inserting segment 921 of the connecting rod 92 extend out of the two opposite slots 822, 823 and are engaged, thus limiting a rotation of the covering member 82. Furthermore, between the covering member 82 and the base 81 is defined a connecting structure for preventing the covering member 82 from disengagement from the base 81. In this embodiment, the connecting structure includes a threaded aperture 816 defined on a central position of the top surface of the base 81 and an opening 824 formed on the top surface of the covering member 82 so as to correspond to the threaded aperture 816 of the base 81, and a bolt element 84 screws with the threaded aperture 824 of the covering member 82 via the opening 824 of the covering member 82, such that the covering member 82 connects with the base 81, thus assembling the tool box 80.

Figure 14:
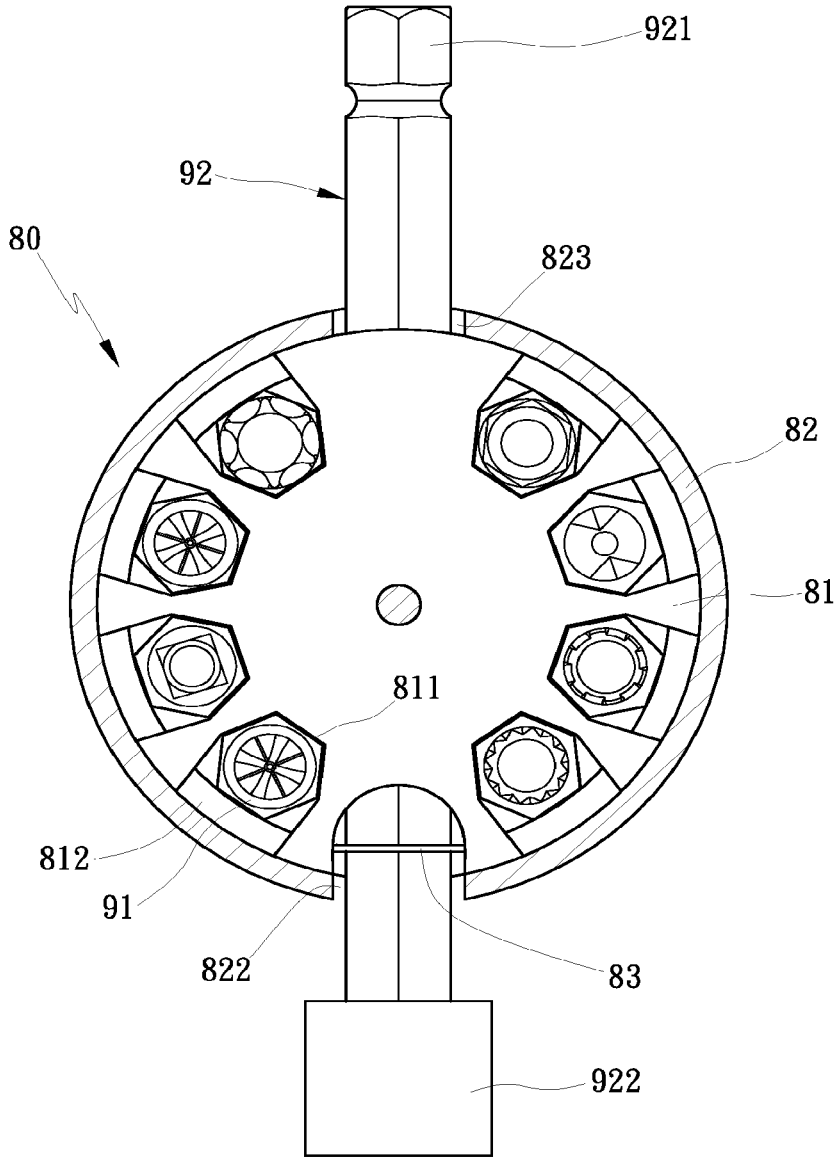
FIG. 14 is a cross sectional view showing the assembly of a part of the rotary tool box according to the third embodiment of the present invention.
Figure 15:
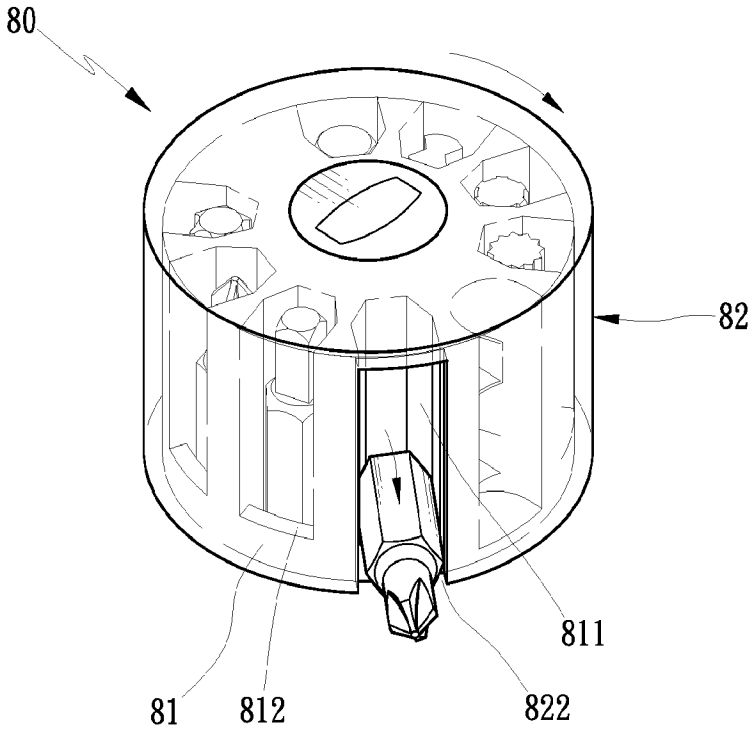
FIG. 15 is a perspective view showing the operation of the rotary tool box according to the third embodiment of the present invention.
Figure 16:
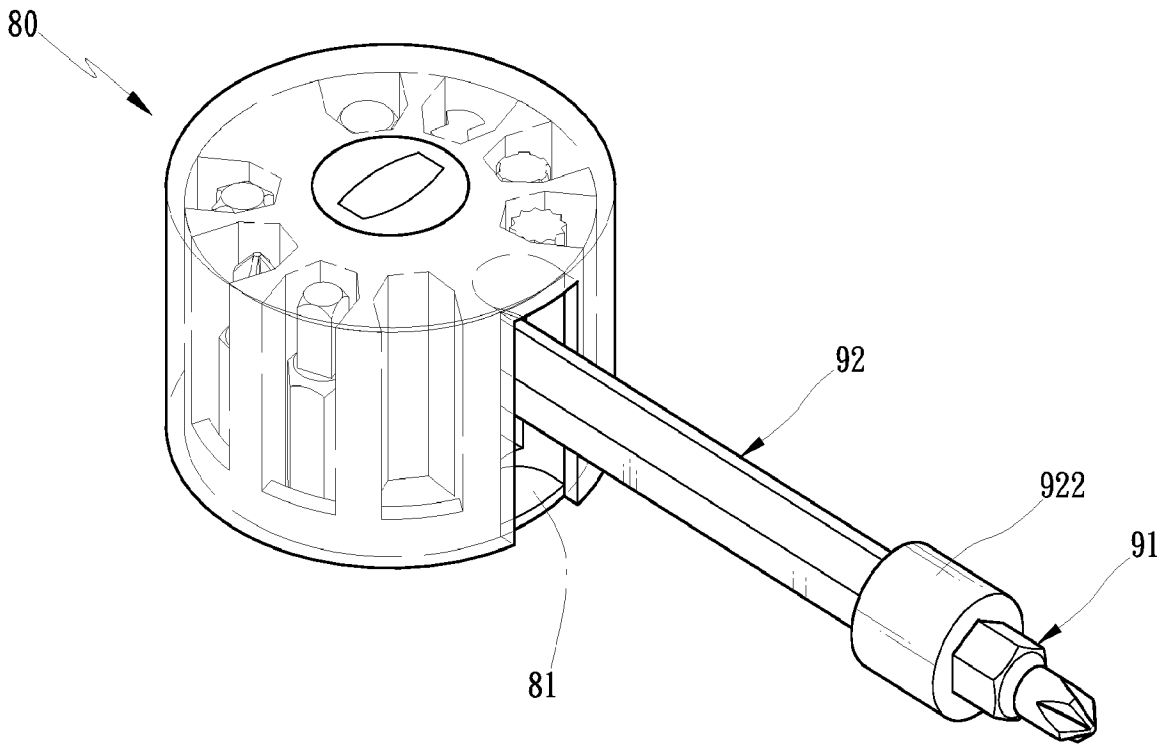
FIG. 16 is another perspective view showing the operation of the rotary tool box according to the third embodiment of the present invention.

Referring further to FIGS. 13 and 14, when the tool box 80 is placed in the store for sales, because the covering member 82 is transparent, the plural bits 91 are received in the base 81 for display to consumers. Thereby, the consumer allows selecting one of the bits 81 with a desired size. Moreover, the tool box 80 is provided to store the connecting rod 92 for driving the plural bits 91, the inserting segment 921 and the fitting segment 922 of the connecting rod 92 extend out of the base 81 so as to be used as two stopping shoulders, hence the two opposite slots 822, 823 of the covering member 82 engage with the fitting segment 922 and the inserting segment 921 of the connecting rod 92, thus limiting the rotation of the covering member 82. Since a slot 822 of the covering member 82 does not correspond to the plurality of grooves 811 of the base 81 so that the covering member 82 limits the plural bit 91 in the base 81, thus preventing the plural bits 91 from being stolen. As shown in FIGS. 14 and 15, after the consumer purchases the plural sleeves 91 and the connecting rod 92, the fastening element 83 is removed from the base 81 so as to release a positioning of the connecting rod 92, hence the connecting rod 92 is pulled out of the slot 822 of the covering member 82. Because the connecting rod 92 does not engage with the two opposite slots 822, 823 of the covering member 82, when the consumer is desired to remove the plural bits 91 from the tool box 80, the covering member 82 is rotated along the outer surface of the base 81 so that the slot 822 of the covering member 82 corresponds to a desired bit 91 in the base 81. Since the plurality of recesses 812 pass through the outer surface of the base 81 and the plurality of grooves 811, the desired bit 91 tilts toward a peripheral side of the base 81 and removes from the slot 822 of the covering member 82, and the other bits 91 are limited in the base 81 by ways of the covering member 82. As illustrated in FIGS. 12 and 16, after removing the desired bit 91 and the connecting rod 92, the desired bit 91 is fitted with the fitting segment 922 of the connecting rod 92, and the inserting segment 921 of the connecting rod 92 is inserted through the coupling portion 814 of the base 81 so that the tool box 80 is manually held and the connecting rod 92 is rotated by a user, hence the connecting rod 92 drives the bit 91 to assemble or disassemble a workpiece.

While the preferred embodiments of the invention have been set forth for the purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

What is claimed is:

1. A rotary tool box comprising:

at least one driving tool;

a base including a plurality of receiving portions for receiving plural tools and at least one accommodation room for holding said driving tool, at least one end of which extends out of the at least one accommodation room;

a covering member covered on the base and including at least one orifice defined on a top surface thereof so as to remove or place the said driving tool, the covering member also including at least one slot formed on an outer surface thereof so that at least one end of said driving tool extends out of the accommodation room and is engaged;

wherein the base includes an upright column extending upwardly therefrom, the upright column includes an accommodation room passing therethrough so that said driving tool is inserted into the accommodation room and its at least one end extends out of the accommodation room, such that the said driving tool would prevent rotation of the covering member when placed in the accommodation room.

2. The rotary tool box as claimed in claim 1, wherein the base includes a plurality of recesses formed around an outer surface thereof and communicating with the plurality of receiving portions.

3. The rotary tool box as claimed in claim 1, wherein at least one end of the accommodation room passes through the outer surface of the base, such that the at least one driving tool is fitted to the base and at least one end of the at least one driving tool extends out of the accommodation room.

4. The rotary tool box as claimed in claim 1, wherein between the covering member and the base is defined a connecting structure for preventing the covering member from disengagement from the base.

5. A rotary tool box comprising:

at least one driving tool;

a base including a plurality of receiving portions for receiving plural tools, a plurality of recesses formed around an outer surface thereof and communicating with the plurality of receiving portions so that the plural tools are removed from the base, and at least one accommodation room for holding said at least one driving tool, at least two ends of which extend out of the at least one accommodation room;

a covering member covered on the base and including at least two slots formed on an outer surface thereof so that the at least two ends of the at least one driving tool extends out of the accommodation room and the covering member are engaged to prevent rotation of the covering member, and the plural tools are removed or placed into the base.

6. The rotary tool box as claimed in claim 5, wherein the base further includes a coupling portion for inserting the at least one driving tool.

7. The rotary tool box as claimed in claim 5, wherein at least one end of the accommodation room passes through the outer surface of the base, such that the at least one driving tool is fitted to the base and at least one end of the at least one driving tool extends out of the accommodation room.

8. The rotary tool box as claimed in claim 5, wherein the base includes an upright column extending upwardly thereform, the upright column includes an accommodation room passing therethrough so that a driving tool is inserted into the accommodation room and its at least one end extends out of the accommodation room.

9. The rotary tool box as claimed in claim 5, wherein between the covering member and the base is defined a connecting structure for preventing the covering member from disengagement from the base.

* * * * *